United States Patent [19]

Wheelwright

[11] Patent Number: 4,844,491

[45] Date of Patent: Jul. 4, 1989

[54] WHEELED SKATE

[75] Inventor: Joseph S. Wheelwright, Boston, Mass.

[73] Assignee: J. S. Wheelwright Company, Inc., Hingham, Mass.

[21] Appl. No.: 179,065

[22] Filed: Apr. 8, 1988

[51] Int. Cl.[4] ..... A63C 17/14

[52] U.S. Cl. ..... 280/11.2; 280/11.26; 280/11.28; 280/11.3; 280/11.36; 36/115

[58] Field of Search ..... 280/11.1 BT, 11.1 BR, 280/11.19, 11.2, 11.25, 11.26, 11.27, 11.28, 11.3, 11.31, 11.33, 11.34, 633, 619, 11.36; 36/62, 64, 66, 115; 301/5.3, 5.7

[56] References Cited

U.S. PATENT DOCUMENTS

| | | | |
|---|---|---|---|
| 5,707 | 12/1873 | Gregg | 280/11.19 |
| 138,018 | 4/1873 | Gregg | 280/11.19 |
| 584,089 | 6/1897 | Buttermilch | 280/11.23 |
| 593,278 | 11/1897 | Moulton | 280/11.27 |
| 1,017,162 | 2/1912 | Naumann | 280/11.2 |
| 1,141,454 | 6/1915 | Fordice | 280/11.36 |
| 1,393,813 | 10/1921 | Muck | 280/11.19 |
| 1,421,532 | 7/1922 | Muck | 280/11.2 |
| 1,728,063 | 9/1929 | James | 280/11.23 |
| 1,751,942 | 3/1930 | Nanz | 280/11.25 |
| 1,854,188 | 4/1932 | Gregory | 280/11.31 |
| 2,044,211 | 6/1936 | Hedelund | 280/11.31 |
| 2,048,916 | 7/1936 | Bentzlin | 280/11.2 |
| 2,434,501 | 1/1948 | Lonze | 301/5.7 |
| 2,520,793 | 8/1950 | Blackwell | 280/11.2 |
| 2,725,238 | 11/1955 | Day | 280/11.2 |
| 2,732,217 | 1/1956 | Dore | 280/11.33 |
| 2,980,436 | 4/1961 | Kosach | 280/11.24 |
| 3,008,725 | 11/1961 | Stites | 280/11.2 |
| 3,086,787 | 4/1963 | Wyche | 280/11.19 |
| 3,392,986 | 7/1968 | Ryan et al. | 280/11.115 |
| 3,484,116 | 12/1969 | Allen | 280/11.21 |
| 3,662,435 | 5/1972 | Allsop | 24/70 SK |
| 3,823,952 | 7/1974 | Kukulowicz | 280/11.2 |
| 3,950,001 | 4/1976 | Weigl | 280/633 X |
| 3,997,179 | 12/1976 | de Blois | 280/11.24 |
| 4,072,317 | 2/1978 | Pommerening | 280/11.3 X |
| 4,090,283 | 5/1978 | Woolley | 301/5.3 X |
| 4,265,462 | 5/1981 | Willi | 280/11.36 |
| 4,294,456 | 10/1981 | Tuell et al. | 280/11.28 |
| 4,298,209 | 11/1981 | Peters | 280/11.2 |
| 4,305,598 | 12/1981 | Brandner | 280/11.2 |
| 4,319,759 | 3/1982 | Neitz | 280/11.2 |
| 4,394,028 | 7/1983 | Wheelwright | 280/11.19 |
| 4,418,929 | 12/1983 | Gray | 280/11.23 |
| 4,523,767 | 6/1985 | Le Page | 280/11.19 |
| 4,708,352 | 11/1987 | Vullierme | 280/11.28 X |
| 4,767,127 | 8/1988 | Olivieri | 280/11.33 |

FOREIGN PATENT DOCUMENTS

| | | | |
|---|---|---|---|
| 853981 | 4/1940 | France | 280/11.2 |
| 22137 | 4/1901 | Switzerland | 280/11.27 |
| 908566 | 10/1962 | United Kingdom | 280/11.26 |

OTHER PUBLICATIONS

Wheelwright Product Literature, "Wheel Right Skate".

*Primary Examiner*—Charles A. Marmor
*Assistant Examiner*—Brian J. Johnson

[57] ABSTRACT

A wheeled skate vehicle consists of an elongated foot support platform, a front wheel fixedly mounted to and extending above the platform, a pair of side wheels mounted on both sides of the platform to rotate about a side wheel axis and extending above the platform, a brake pad attached to platform rearwardly of the side wheel axis, and bindings for releasably securing a skater's foot to the platform. The bindings include a toe shroud defining an aperture adapted to receive and confine against lateral and forward motion a toe of a skater's shoe, a heel cup defining a recess adapted to receive and confine against lateral and rearward motion a heel of a skater's shoe, a foot strap attached to the skate and a foot strap receptor for releasably engaging an end of the foot strap, and an ankle brace pivotally attached to the skate and supporting thereabove an ankle strap and ankle strap receptor for releasably engaging an end of the ankle strap extending about a skater's ankle. The distance between the toe shroud and heel cup is adjustable for accommodation of the skate to a range of shoe sizes. In preferred embodiments, the height of the braking surface is also adjustable.

19 Claims, 4 Drawing Sheets

10
13
14
16
17
18
19
26
31
36
38
39
40
52
53
54
59
60
62
64
84
86
90
91
92
94
96
98
100
102
A
B
C
E

A
C
F
10
14
16
18
31
32
34
36
38
39
40
42
44
46
48
50
52
56
84
86
88
94
96
102
104
105
17
19
26

WHEELED SKATE

The invention relates to wheeled skate vehicle.

Skates, including wheeled skates and roller skates, are well known, and typically consist of a platform for the foot, and three or four wheels. A skate boot or shoe may be fixedly mounted upon each platform, or clamps, straps or other means may be provided to attach the skates to a user's feet. A wheeled skate shown in U.S. Pat. No. 4,394,028, by the Applicant herein, has a pair of side wheels and a front wheel, all extending above the foot platform bearing a skate boot, and a vertically adjustable rear braking means, e.g., a fourth wheel usually disposed out of contact with the skating surface.

SUMMARY OF THE INVENTION

According to the invention, a wheeled skate vehicle comprises an elongated foot support platform, a front wheel fixedly mounted to and extending above the platform, a side wheel mounted on each side of the platform, the side wheels extending above the platform and rotating about a side wheel axis, a brake pad attached to the platform rearwardly of the side wheel axis, and means for releasably securing a skater's foot to the platform, comprising: a toe shroud defining an aperture adapted to receive and confine against lateral and forward motion a toe of a skater's shoe, a heel cup defining a recess adapted to receive and confine against lateral and rearward motion a heel of a skater's shoe, means for adjusting the distance between the toe shroud and heel cup for accommodation of the skate to a range of shoe sizes, a foot strap attached to the skate and sized and adapted to extend about a skater's foot disposed upon the platform, and foot strap receptor means for releasably engaging an end of the foot strap, and an ankle brace pivotally attached to the skate and supporting thereabove an ankle strap and ankle strap receptor means for releasably engaging an end of the ankle strap extending about a skater's ankle.

Preferred embodiments of the invention may include one or more of the following features. The toe shroud further comprises an integral, axially-extending tongue, and the foot strap is connected to the tongue. The foot strap receptor means for releasably engaging an end of the foot strap is disposed below the foot platform, and preferably the skate further comprises a deflector disposed below the foot platform, forward of the strap receptor means, for protection of the strap receptor means against damage or inadvertent release. The foot strap has a pair of ends for engagement by strap receptor means. The ankle brace further comprises a pad disposed between ankle strap and a skater's ankle. The ankle strap is releasably secured to the ankle brace in a manner to allow vertical adjustment of the ankle strap relative to the platform to suit a range of skaters. The means for adjusting the distance between toe shroud and heel cup comprises a rear base unit releasably connected to the foot platform and slidable therealong for adjustment of the distance to suit a skater, and means for securing the rear base unit to the platform for fixing the distance during skating. Preferably the means for securing the rear base unit to the platform comprises a pair of oppositely acting, spring-biased adjustment clips adapted to secure the rear base unit to the platform. More preferably, the adjustment clips are pivotally attached to the rear base unit, the platform defines two rows of teeth, and the adjustment clips are sized and constructed to releasably engage the rows of teeth to secure the axial position of the rear base unit upon the platform. Also, it is preferable that the rear base unit further comprise a U-shape yoke with the side wheels mounted thereupon, and the side wheel axis is axially adjustable with the rear base unit relative to the platform. The brake pad defines a braking surface, and the pad further comprises a bracket releasably secured to the skate, whereby the vertical distance of the braking surface from a skating surface is adjustable to suit a range of skaters. At least one of the wheels comprises a two-ply metal hub defining a pair of outward directed peripheral flanges terminating in opposed, inwardly directed rims, and a polyurethane tire, the body of the tire captured between rims.

The invention thus provides a wheeled skate vehicle that is markedly improved, both in terms of performance and in terms of aesthetics, over prior wheeled skate vehicles. More specifically, the wheeled skate may be quickly and simply adjusted to fit the shoe size and skating ability of a wide range of skaters who must simply slip their street shoes into the toe shroud, slide the rear base unit forward or back to fit the position of the universal heel cup to the shoe heel (and also to adjust the position of the side wheel axis and brake to fit the position of the skater on the foot platform), adjust the height of the ankle strap, and feed the end portions of the foot and ankle straps into the respective strap receptors. When desired, the vertical position of braking surface of the brake pad may also be adjusted. Once on the skates, the skater finds that the structural features provide an improved skating performance, e.g., the straps are comfortable, and the combination of toe shroud, heel cup, foot strap and padded ankle strap make the skates easy to operate; the movement of the side wheel axis during turning also make these skates easier to use. Finally, the skates have an improved aesthetic appearance, beginning with the toe shroud mounted to straddle and streamline the front wheel mounting.

These and other features and advantages of the invention will be seen from the following description of a presently preferred embodiment, and from the claims.

PREFERRED EMBODIMENT

We first briefly describe the drawings.

FIG. 1 is a side view of a wheeled skate vehicle of the invention, partially in section;

FIG. 2 is at top view, while FIGS. 3 and 4 are somewhat diagrammatic front and rear views of the skate of FIG. 1;

Figures 1, 3:
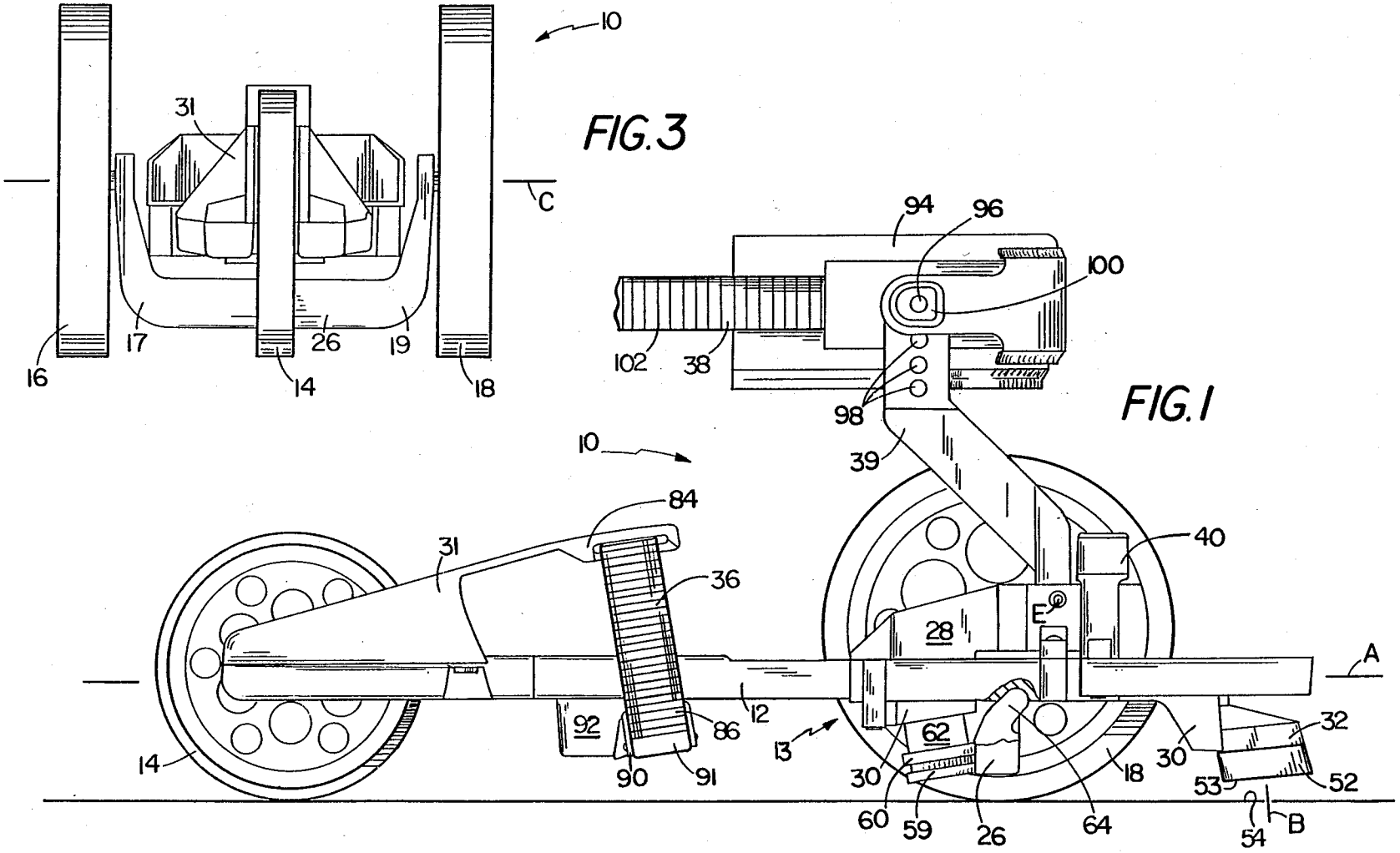
Figures 2, 4:
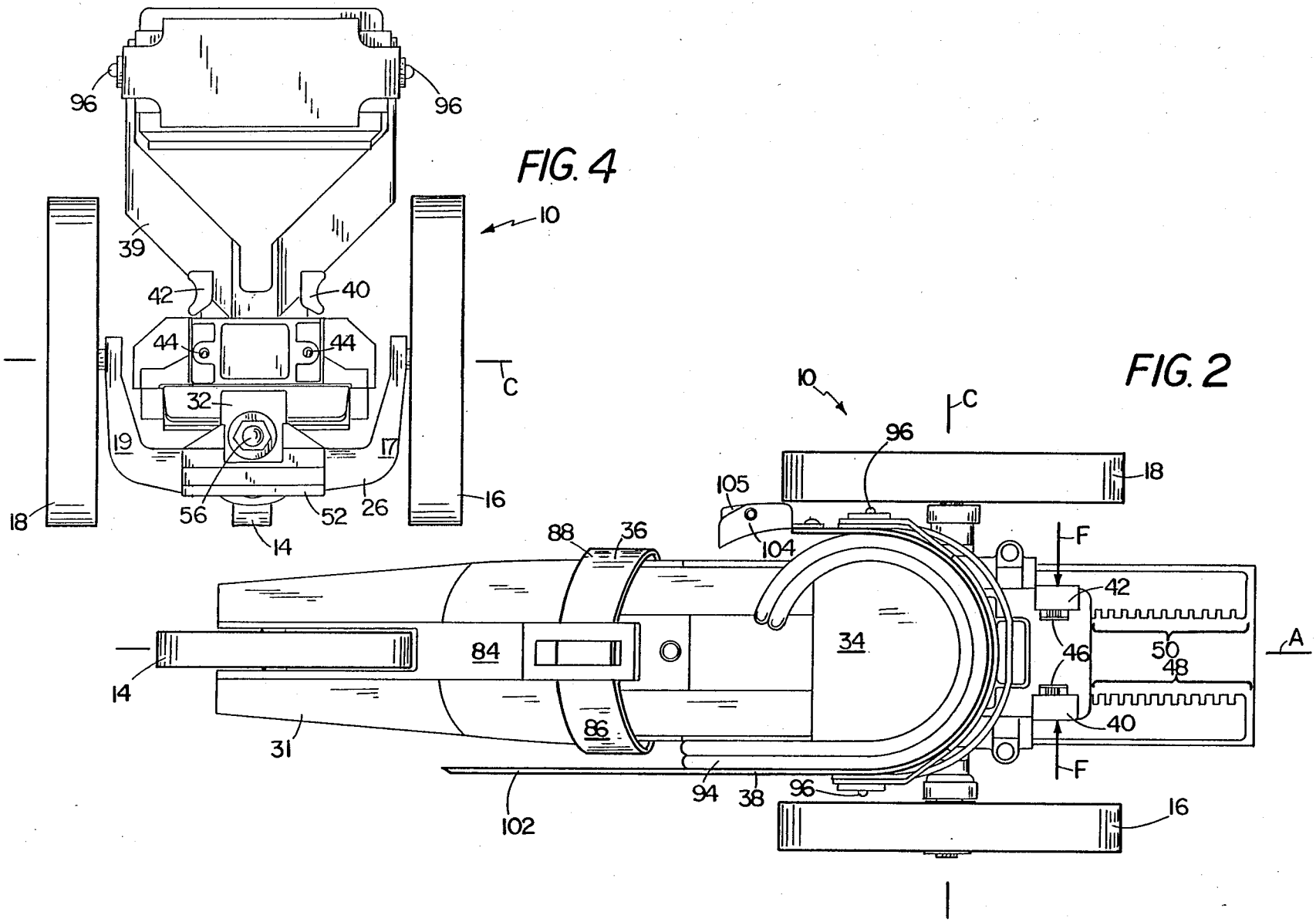
Figure 5:
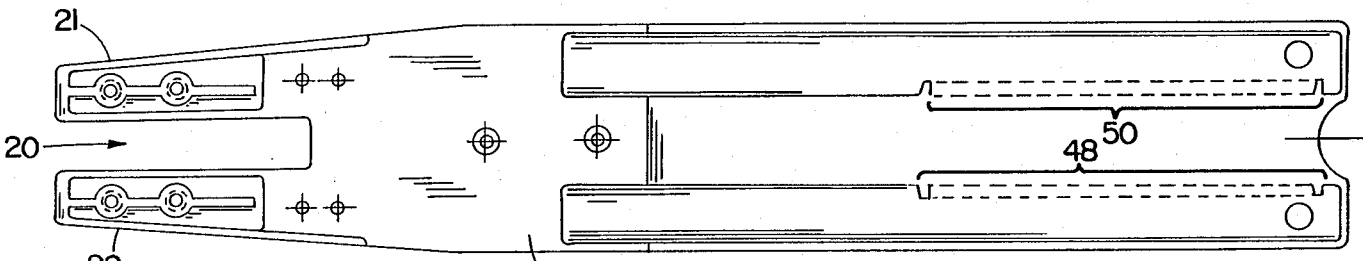
Figure 5A:
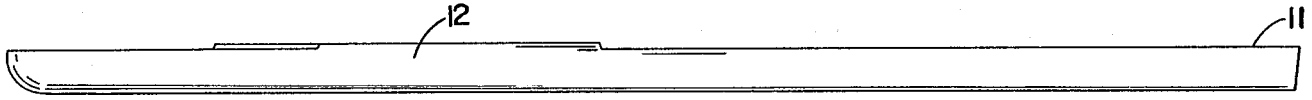
Figure 7:
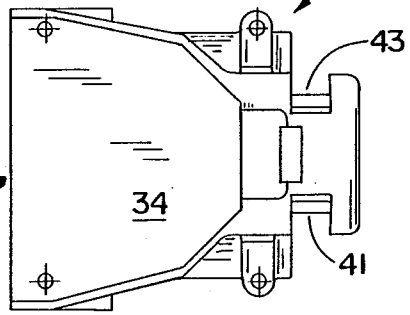
Figure 7A:
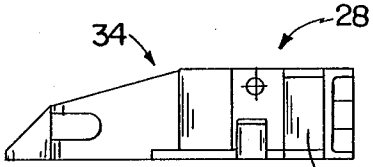
Figure 6A:
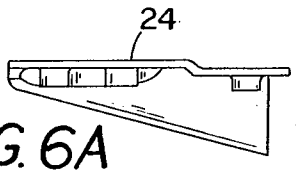
Figure 6:
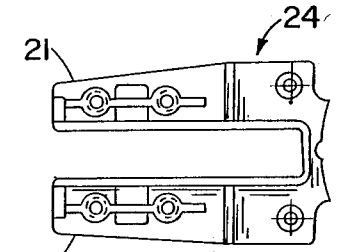

FIGS. 5 and 5*a* are respective top and side views of the foot plate of the skate of FIG. 1;

FIGS. 6 and 6*a* are respective bottom and side views of the front wheel bracket of the skate of FIG. 1;

FIGS. 7 and 7*a* are top and side views, and

Figure 11:
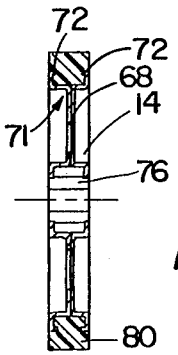
Figure 11A:
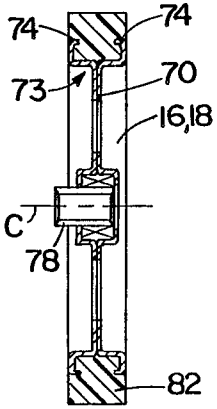
Figure 9B:
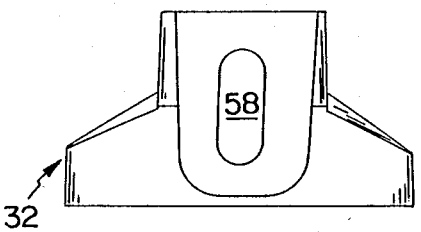
Figure 9:
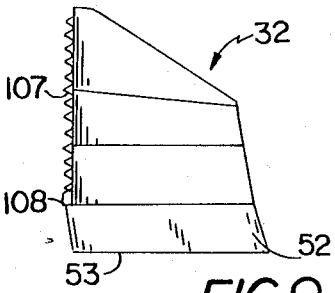
Figure 9A:
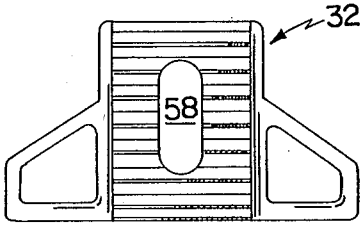
Figure 8:
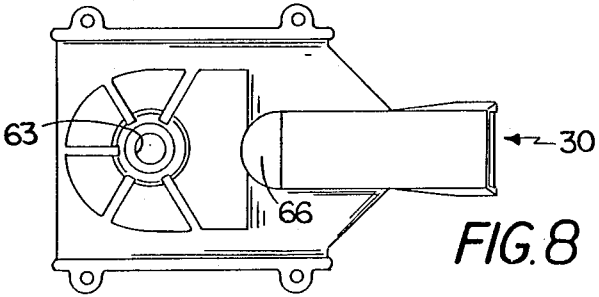
Figure 8A:
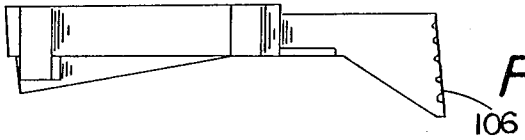
Figure 8B:
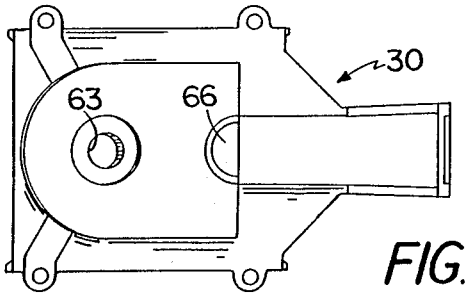
Figure 10:
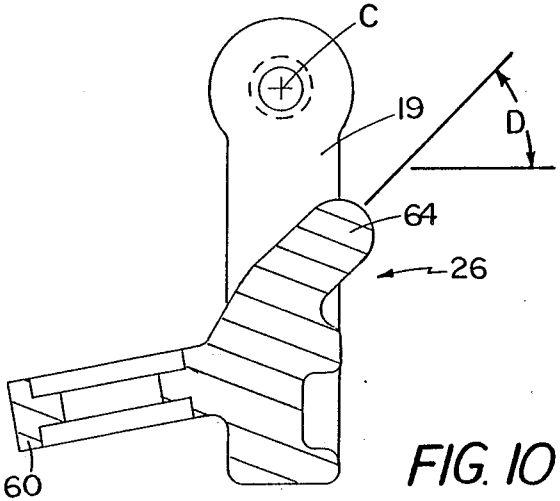

FIGS. 8, 8*a* and 8*b* are top, side and bottom views of the respective top and bottom elements of the rear base of the skate of FIG. 1;

FIGS. 9, 9*a* and 9*b* are side, front and rear views of the brake pad bracket of the skate of FIG. 1;

FIG. 10 is a side section view of the rear wheel yoke of the skate of FIG. 1, and FIGS. 11 and 11*a* are sectional views of the front and side wheels, respectively, of the skate of FIG. 1.

Referring now to the drawings, a wheeled skate vehicle 10 of the invention (a left skate is shown, FIGS. 1–4)

consists of a foot plate 12 about which are disposed a front wheel 14 and a pair of side wheels 16, 18.

Foot plate 12 (FIGS. 5 and 5*a*) is formed, by molding, of, e.g., a suitable glass-filled engineering resin. Wheel 14 is fixedly mounted at the front of the plate between arms 21, 22 of front yoke 20 by means of front wheel bracket 24 (FIGS. 6 and 6*a*), also formed, e.g., of a suitable glass-filled engineering resin, attached to the plate 12. The rear wheels 16, 18, mounted on U-shaped yoke 26, are connected to rear base unit 13, consisting of top and bottom rear base elements 28, 30 (FIGS. 7 and 7*a* and FIGS. 8, 8*a* and 8*b*, respectively), similarly formed of a suitable glass-filled engineering resin. The rear base unit 13 is disposed about plate 12 in a manner to permit adjustment of the position of the rear base longitudinally along the axis A of the foot plate. Disposed below plate 12, to the rear of yoke 26 and mounted on bottom rear base element 30, is a brake pad bracket 32 (FIGS. 9, 9*a* and 9*b*), formed, e.g., of glass-filled nylon.

Toe cover or shroud 31 at the front of plate 12 is provided to receive the toe of a skater's shoe and defines an integral, axially extending tongue 84. (The shroud and tongue are formed of tough, abrasion resistant resin, e.g., polyester elastomer.) The top rear base element 28 defines a universal heel cup 34 for receiving the heel of a skater's shoe. The skate is comfortably attached to the skater by means of adjustable foot and ankle bindings 36, 38, described more fully below.

As mentioned above, the rear base 13, consisting of elements 28, 30, to which the rear wheels 16, 18, on yoke 26, and the ankle brace 39, bearing the ankle binding strap 38, are mounted, is adjustable along the axis A of plate 12, for the purpose of adjusting the space between toe cover 31 and heel cup 34 to provide for use of the skate 10 by skaters having a range of shoe sizes. The rear base 13 further consists of a pair of opposed adjustment clips 40, 42 mounted in apertures 41, 43 of top rear base element 28. The clips, typically formed of ZYTEL (33% glass filled nylon from E.I. DuPont de Nemours Company of Wilmington, Delaware) are mounted to pivot about pins 44, and are biased by springs 46 urging the upper ends outwardly. The rear base 13 is held fixedly in position by engagement of the lower end portions of adjustment clips 40, 42 in rows 48, 50 of teeth defined by the plate 12. The position of rear base 13 is adjusted by squeezing the upper ends of the adjustment clips together (arrows F), against the force of springs 46, to disengage the lower ends of the clips from the teeth. The position of the rear base 13 may then be adjusted longitudinally to fit the skater's foot.

A brake pad 52, e.g., of polyurethane, is attached beneath bracket 32, and is disposed above the ground surface 54. The vertical position of the braking surface 53 of brake pad 52 is adjustable (along axis B) by means of bolt 56 in slot 58 fixing the bracket to bottom rear base element 30, to suit the particular needs and desires of the skater. For example, a more experienced skater may set the brake pad at a relatively greater distance from the ground while a less experienced skater may set the pad closer to the ground to require less tilting movement of the skate for braking engagement. The brake pad may be removed and replaced as desired, e.g., due to wear.

The rear wheels 16, 18, mounted on arms 17, 19 of yoke 26 (FIG. 10), are disposed to rotate about axles disposed on an axis C lying generally above the surface 11 of the foot plate 12. The yoke 26, e.g., formed of investment cast stainless steel, is mounted to bottom rear base element 30 via bolt 59 extending through yoke tongue 60 and rubber or plastic cushion 62, into orifice 63 of element 30. Yoke pivot pin 64, disposed at an angle D, e.g., 45° to horizontal, engages in aperture 66 of the bottom rear base element. In turning, as the skater shifts his or her weight, the yoke 26 pivots on pin 64 in aperture 66 and the tongue 60 shifts with cushion 62, allowing the wheel axis C to swivel for turning of the skate.

The front wheel 14 (FIG. 11) and side wheels 16, 18 (FIG. 11*a*) have metal hubs 68, 70 and center wheel bearings 76, 78. The metal hubs are formed, e.g., of two-ply cold rolled steel, with outwardly extending flanges 71, 73 at their outer peripheries, terminating in opposed, inwardly directed rims 72, 74. The wheel tires 80, 82 are of polyurethane with the flange rim engaging the tire bodies to capture the tires to the hubs.

Referring again to FIGS. 1 and 2, the foot strap 36 extends through the integral tongue 84 of toe cover 31, with the respective ridged end portions 86, 88 of the foot strap engaged in strap receptors 90 (only one is shown), e.g., of a type used for ski boot binding straps and described in U.S. Pat. No. 3,662,435, the relevant disclosure of which is incorporated herein by reference. The ridged end portions of the straps ratchet inwardly through the strap receptors to allow the strap ends to be pushed through the receptors for tightening, but the receptors automatically resist loosening of the straps, unless the receptor latch 91 is released. The foot strap receptors 90, disposed beneath the foot plate 12, are protected from inadvertent release or damage by contact with the ground by deflector 92, formed, e.g., of glass-filled nylon.

The ankle brace 39, formed, e.g., of polyester elastomer, is piovtally mounted, at axis E, on top rear base element 28, and extends upwardly to support ankle strap 38 disposed about foam-filled pad 94. The vertical height of the ankle strap is also adjustable to suit each particular skater by engagement of straps studs 96 in apertures 98, held by snaps 100. The ends portion 102 of the ankle strap 38 is similar ridged for ratcheting engagement in a strap receptor 104 also of the type described above with reference to the foot strap.

To use the skates 10 of the invention, a skater, wearing his usual street shoes, sneakers, etc., quickly adjusts the skates to his or her needs and desires by placing his or her shoe onto the foot platform 12 and inserting the shoe toe into toe cover or shroud 31. Grasping the upper ends of adjustment clips 40, 42, the skater squeezes the clip ends together (arrows F) to pivot the clips about pins 44 against the force of springs 46. This disengages the lower ends of clips 40, 42 from rows 48, 50 of teeth defined by the platform, and the rear base is moved axially forward or back until the heel of the skater's shoe rests snuggly in universal heel cup 34. The clips are then released, and springs cause the lower ends to reengage the rows of teeth to fix the distance between toe cover and heel cup during skating. This adjusted, the toe cover serves to secure the skater's toe against forward and lateral motion while the heel cup serves to secure the skater's heel against rearward and lateral motion.

The skater next secures the skate to his or her foot by adjusting the foot strap 36 in tongue 84 of the toe cover, and inserting the ridged end portions 86, 88 of the strap through the respective foot strap receptors (e.g., 90). The receptors ratchet as the strap end portions are pushed in and prevent loosening of the strap until the receptor latch 91 is released.

The skater next pivots ankle brace 39 about axis E to contact the pad 94 against the lower shin or ankle. If desired, the ankle pad and strap are adjusted vertically by disengaging snaps 100 and positioning studs 96 in apertures 98 at the desired height. The snaps are replaced, and the ridged end portion 102 of the ankle strap 38 is engaged in ankle strap receptor 104, again, as described above, the strap ratchets into the receptor to hold until latch 105 is released.

The height of the braking surface 53 above the ground 54 is also adjustable as desired. For example, the speed at which the brake is engaged (i.e., the amount of rearward foot tilt required) depends on the setting of the height of surface 53, and the location of the bracket 32. A novice, for example, may set the height as low as possible for more rapid brake engagement. The brake is adjusted by loosening bolt 56 in slot 58 sufficiently to provide clearance between grooved mounting surface 106 of the bottom rear base element 30 (FIG. 8*a*) and the corresponding, opposed ridged surface 107 of brake bracket 32 (FIG. 9). The bracket is moved along axis B to obtain the desired position (the forward edge 108 of brake pad 52 extends forward beyond surface 107 to prevent the bracket from being set too high), and bolt 56 is retightened to cause surfaces 106, 107 to reengage.

Other embodiments are within the following claims.

What is claimed is:

1. A wheeled skate vehicle comprising an elongated foot support platform a front wheel fixedly mounted to and extending above said platform, a side wheel mounted on each side of said platform said side wheels extending above said platform and rotating about a side wheel axis, a brake pad attached to said platform rearwardly of the side wheel axis, and means for releasably securing a skater's foot to said platform comprising:

a toe shroud defining an aperture adapted to receive and confine against lateral and forward motion a toe of a skater's shoe, a heel cup defining a recess adapted to receive and confine against lateral and rearward motion a heel of a skater's shoe, means for adjusting the distance between said tow shroud and heel cup for accommodation of said skate to a range of shoe sizes, a foot strap attached to said skate and sized and adapted to extend about a skater's foot disposed upon said platform, and foot strap receptor means disposed beneath said platform for releasably engaging and securing an end of said foot strap below said foot platform a deflector disposed below said foot platform, forward of said strap receptor means, for protection of said strap receptor means against damage or inadvertant release and an ankle brace pivotally attached to said skate and supporting thereabove an ankle strap and ankle strap receptor means for releasably engaging an end of said ankle strap extending about a skater's ankle.

2. A wheeled skate vehicle comprising an elongated foot support platform, a front wheel fixedly mounted to and extending above said platform, a side wheel mounted on each side of said platform, said side wheels extending above said platform and rotating about a side wheel axis, a brake pad attached to said platform rearwardly of the side wheel axis, and means for releasably securing a skater's foot to said platform comprising:

a toe shroud defining an aperture adapted to receive and confine against lateral and forward motion a toe of a skater's shoe, a heel cup defining a recess adapted to receive and confine against lateral and rearward motion a heel of a skater's shoe, means for adjusting the distance between said toe shroud and heel cup for accommodation of said skate to a range of shoe sizes, a foot strap attached to said skate and sized and adapted to extend about a skater's foot disposed upon said platform, and foot strap receptor means for releasably engaging an end of said foot strap, and an ankle brace pivotally attached to said skate rearwardly of said heel cup, said ankle brace having a pair of arms disposed in fixed relationship to extend generally forwardly and upwardly at opposite sides of a wearer's ankle and supporting thereabove an ankle strap and ankle strap receptor means for releasably engaging an end of said ankle strap extending about a skater's ankle, snap means for releasably securing said ankle strap to the respective arms of said ankle brace, at opposite sides of a wearer's ankle, to allow vertical adjustment of said ankle strap relative to said platform to suit a range of skaters.

3. A wheeled skate vehicle an elongated foot support platform, a front wheel fixedly mounted to and extending above said platform, a side wheel mounted on each side of said platform, said side wheels extending above said platform and rotating about a side wheel axis, a brake pad attached to said platform rearwardly of the side wheel axis, and means for releasably securing a skater's foot to said platform comprising:

a toe shroud defining an aperture adapted to receive and confine against lateral and forward motion a toe of a skater's shoe, a heel cup defining a recess adapted to receive and confine against lateral and rearward motion a heel of a skater's shoe, means for adjusting the distance between said toe shroud and heel cup for accommodation of said skate to a range of she sizes comprising a rear base unit releasably connected to said foot platform and slidable therealong for adjustment of said distance to suit a skater, and means for securing said rear base unit to said platform for fixing said distance during skating, said rear base unit further comprising a U-shape yoke with said side wheels mounted thereupon, and said side wheel axis being axially adjustable with said rear base unit relative to said platform, a foot strap attached to said skate and size and adapted to extend about a skater's foot disposed upon said platform, and foot strap receptor means for releasably engaging an end of said foot strap, and an ankle brace pivotally attached to said skate and supporting thereabove an ankle strap and ankle strap receptor means for releasably engaging an end of said ankle strap extending about a skater's ankle.

4. A wheeled skate vehicle comprising an elongated foot support platform, a front wheel fixedly mounted to and extending above said platform, a side wheel mounted on each side of said platform, said side wheels extending above said platform and rotating about a side wheel axis, a brake pad attached to said platform rearwardly of the side wheel axis, said brake pad defining a braking surface, and said pad further comprising a bracket releasably secured to said skate, whereby the vertical distance of said braking surface from a skating surface is adjustable to suit a range of skaters, and means for releasably securing a skater's foot to said platform comprising:

a toe shroud defining an aperture adapted to receive and confine against lateral and forward motion a toe of a skater's shoe, and comprising an integral, axially-extending tongue, a heel cup defining a recess adapted to receive and confine against lateral and rearward motion a heel of a skater's shoe, means for adjusting the distance between said toe shroud and heel cup for accommodation of said skate to a range of shoe sizes, a foot strap connected to said tongue and sized and adapted to extend about a skater's foot disposed upon said platform, and foot strap receptor means for releasably engaging an end of said foot strap, said foot strap receptor means disposed below said foot platform, and an ankle brace pivotally attached to said skate and supporting thereabove an ankle strap and ankle strap receptor means for releasably engaging an end of said ankle strap extending about a skater's ankle, said ankle strap releasably secured to said ankle brace in a manner to allow vertical adjustment of said ankle strap relative to said platform to suit a range of skaters, said means for adjusting the distance between said toe shroud and heel cup comprises a rear base unit releasably connected to said foot platform and slidable therealong for adjustment of said distance to suit a skater, and means for securing said rear base unit to said platform for fixing said distance during skating, comprising a pair of oppositely acting, spring-biased adjustment clips adapted to secure said rear base unit to said platform, said adjustment clips pivotally attached to said rear base unit, said platform defining two rows of teeth, and said adjustment clips being sized and constructed to releasably engage said rows of teeth to secure the axial position of said rear base unit upon said platform, and said rear base unit comprising a U-shape yoke with said side wheels mounted thereupon, whereby said side wheel axis is axially adjustable relative to said platform.

5. The skate of claim 4 wherein said skate further comprising a deflector disposed below said foot platform, forward of said strap receptor means, for protection of said strap receptor means against damage or inadvertent release.

6. The skate of claim 4 wherein said foot strap has a pair of ends for engagement by said strap receptor means.

7. The skate of claim 4 wherein said ankle brace further comprises a pad disposed between said ankle strap and a skater's ankle.

8. The skate of claim 4 wherein at least one of said wheels comprises a two-ply metal hub defining a pair of outward directed peripheral flanges terminating in opposed, inwardly directed rims, and a polyurethane tire, the body of said tire captured between said rims.

9. A wheeled skate vehicle comprising an elongated foot support platform, a front wheel fixedly mounted to and extending above said platform, a side wheel mounted on each side of said platform, said side wheels extending above said platform and rotating about a side wheel axis, a brake pad attached to said platform rearwardly of the side wheel axis, said brake pad defining a braking surface; and said pad further comprising a bracket releasably secured to said skate, whereby the vertical distance of said braking surface from a skating surface is adjustable to suit a range of skaters, and means for releasably securing a skater's foot to said platform comprising:

a toe shroud defining an aperture adapted to receive and confine against lateral and forward motion a toe of a skater's shoe, and comprising an integral, axially-extending tongue, a heel cup defining a recess adapted to receive and confine against lateral and rearward motion a heel of a skater's shoe, means for adjusting the distance between said toe shroud and heel up for accomodation of said skate to a range of shoe sizes, a foot strap connected to said tongue and sized and adapted to extend about a skater's foot disposed upon said platform, and foot strap receptor means for releasably engaging an end of said foot strap, said foot strap receptor means disposed below said foot platform a deflector disposed below said foot platform, forward of said strap receptor means, for protection of said strap receptor means against damage or inadvertant release, said means for adjusting the distance between said shroud and heel cup comprises a rear base unit releasably connected to said foot platform and slidable therealong for adjustment of said distance to suit a skater, and means for securing said rear base unit to said platform for fixing said distance during skating, comprising a pair of oppositely acting, spring-biased adjustment clips adapted to secure said rear base unit to said platform, and said adjustment clips pivotally attached to said rear base unit, said platform defining two rows of teeth, and said adjustment clips being sized and constructed to releasably engage said rows of teeth to secure the axial position of said rear base unit upon said platform.

10. The skate of claim 9 wherein said foot strap has a pair of ends for engagement by said strap receptor means.

11. The skate of claim 9 wherein at least one of said wheels comprises a two-ply metal hub defining a pair of outwardly directed peripheral flanges terminating in opposed, inwardly directed rims, and a polyurethane tire, the body of said tire captured between said rims.

12. A wheeled skate vehicle comprising:

an elongated foot support platform, a front wheel fixedly mounted to and extending above said platform, a side wheel mounted on each side of said platform, said side wheels extending above said platform and rotating about a side wheel axis, a brake pad attached to said platform rearwardly of the side wheel axis, and means for releasably securing a skater's foot to said platform comprising:

a toe shroud defining an aperture adapted to receive and confine against lateral and forward motion a toe of a skater's shoe, a heel cup defining a recess adapted to receive and confine against lateral and rearward motion a heel of a skater's shoe, means for adjusting the distance between said toe shroud and heel cup for accommodation of said skate to a range of shoe sizes, a foot strap attached to said skate and sized and adapted to extend about a skater's foot disposed upon said platform, and foot strap receptor means disposed beneath said platform for releasably engaging and securing an end of said foot strap below said foot platform and a deflector disposed below said foot platform, forward of said strap receptor means, for protection of said strap receptor means against damage or inadvertant release

13. The skate of claim 12 wherein said toe shroud further comprises an integral, axially-extending tongue, and said foot strap is connected to said tongue.

14. The skate of claim 12 wherein said foot strap has a pair of ends for engagement by strap receptor means.

15. The skate of claim 12 wherein said means for adjusting the distance between said toe shroud and heel cup comprises a rear base unit releasably connected to said foot platform and slidable therealong for adjustment of said distance to suit a skater, and means for securing said rear base unit to said platform for fixing said distance during skating.

16. The skate of claim 15 wherein said means for securing said rear base unit to said platform comprises a pair of oppositely acting, spring-biased adjustment clips adapted to secure said rear base unit to said platform.

17. The skate of claim 16 wherein said adjustment clips are pivotally attached to said rear base unit, said platform defines two rows of teeth, and said adjustment clips are sized and constructed to releasably engage said rows of teeth to secure the axial position of said rear base unit upon said platform.

18. The skate of claim 12 wherein said brake pad defines a braking surface, and said pad further comprises a bracket releasably secured to said skate, whereby the vertical distance of said braking surface from a skating surface is adjustable to suit a range of skaters.

19. The skate of claim 12 wherein at least one of said wheels comprises a two-ply metal hub defining a pair of outwardly directed peripheral flanges terminating in opposed inwardly directed rims, and a polyurethane tire, the body of said tire captured between said rims.

* * * * *

UNITED STATES PATENT AND TRADEMARK OFFICE

CERTIFICATE OF CORRECTION

PATENT NO. : 4,844,491

DATED : July 4, 1989

INVENTOR(S) : Joseph S. Wheelwright

It is certified that error appears in the above-identified patent and that said Letters Patent is hereby corrected as shown below:

Col. 1, line 4, "vehicle" should be --vehicles--.

Col. 4, line 41, "ends" should be --end--.

Col. 4, line 59, "This" should be --Thus--.

Col. 5, line 34, insert --,-- after "platform".

Col. 5, line 48, "tow" should be --toe--.

Col. 5, line 57, delete "," after "platform".

Col. 5, line 59, insert --,-- after "release".

Col. 6, line 54, "she" should be --shoe--.

Col. 8, line 38, "up" should be --cup--.

Col. 9, line 31, insert --,-- after "platform".

Col. 9, line 34, insert --.-- after "release".

Col. 10, line 32, insert --,-- after "opposed".

Signed and Sealed this

Twenty-fourth Day of April, 1990

*Attest:*

HARRY F. MANBECK, JR.

*Attesting Officer*

*Commissioner of Patents and Trademarks*